US011834141B1

(12) United States Patent
Li et al.

(10) Patent No.: US 11,834,141 B1
(45) Date of Patent: Dec. 5, 2023

(54) HEAVE SURVEY PLATFORM

(71) Applicant: Tianjin University, Tianjin (CN)

(72) Inventors: Xingfei Li, Tianjin (CN); Jiayi Xu, Tianjin (CN); Qingfeng Ma, Tianjin (CN); Yehao Liu, Tianjin (CN); Yicheng Wen, Tianjin (CN); Hongyu Li, Tianjin (CN); Zhendong Wang, Tianjin (CN)

(73) Assignee: TIANJIN UNIVERSITY, Tianjin (CN)

( * ) Notice: Subject to any disclaimer, the term of this patent is extended or adjusted under 35 U.S.C. 154(b) by 0 days.

(21) Appl. No.: 18/310,641

(22) Filed: May 2, 2023

(30) Foreign Application Priority Data

Nov. 1, 2022 (CN) ..... 202211352705.0

(51) Int. Cl.
*B63G 8/18* (2006.01)
*B63G 8/00* (2006.01)
*B63G 8/22* (2006.01)

(52) U.S. Cl.
CPC ..... *B63G 8/18* (2013.01); *B63G 8/001* (2013.01); *B63G 8/22* (2013.01); *B63G 2008/002* (2013.01)

(58) Field of Classification Search
CPC ..... B63G 8/00; B63G 8/001; B63G 8/18; B63G 8/22; B63G 2008/002
USPC ..... 114/330, 331
See application file for complete search history.

(56) References Cited

U.S. PATENT DOCUMENTS

2012/0289103 A1* 11/2012 Hudson ..... B63G 8/18 114/331

FOREIGN PATENT DOCUMENTS

| | | | | |
|---|---|---|---|---|
| CN | 107089312 A | | 8/2017 | |
| CN | 107985535 A | | 5/2018 | |
| CN | 212125484 U | | 12/2020 | |
| CN | 113277044 B | * | 5/2022 | ..... B63G 8/18 |

OTHER PUBLICATIONS

CNIPA, Notification of a First Office Action for CN202211352705.0, Dec. 7, 2022.
Tianjin University (Applicant), Reply to Notification of a First Office Action for CN202211352705.0, w/ (allowed) replacement claims, dated Dec. 19, 2022.
CNIPA, Notification to grant patent right for invention in CN202211352705.0, Dec. 22, 2022.

* cited by examiner

*Primary Examiner* — Lars A Olson
(74) *Attorney, Agent, or Firm* — Zhigang Ma

(57) ABSTRACT

A heave survey platform includes: a body, two fixed wings and two variable wing mechanisms. The two fixed wings are symmetrically disposed on two sides of a middle part of the body, and an axis of the body is located in a plane defined by extension directions of the two fixed wings. Each variable wing mechanism includes a variable wing, and the two variable wings of the two variable wing mechanisms are symmetrically disposed on two sides of a lower end of the body, and each variable wing is configured to swing between a first position coplanar with the plane and a second position forming an angle with the plane to generate a lift force on the body at the second position, thereby to make the body move in a radial direction or change attitude.

9 Claims, 5 Drawing Sheets

HEAVE SURVEY PLATFORM

TECHNICAL FIELD

The disclosure relates to the technical field of marine monitoring equipment, in particular to a heave survey platform.

BACKGROUND

With the deepening of the understanding of the world marine environment, the prediction of environmental changes and the wide application of underwater navigation and detection, the observation and research in the ocean have attracted more and more attention.

Heave survey platforms, as devices for collecting and monitoring section data of marine elements, are widely used in the field of surveying the temperature and/or salinity and/or biochemical parameters of the deep-sea marine environment. Moreover, the heave survey platform can be used as an auxiliary positioning device for detecting underwater moving targets, providing positioning navigation time service for underwater moving carriers and/or providing position calibration/time service for underwater platforms.

At present, most of the heave survey platforms used only change buoyancy to realize heave motion, but they can't control horizontal motion by themselves. Underwater gliders can actively adjust the horizontal motion by changing the buoyancy and the center of gravity, but the vertical motion speed is slow, although the area fixed-point observation can be performed through short-term spiral motion. However, neither platform can satisfy long-term survey in a fixed area.

In view of the above shortcomings, some of the heave survey platforms based on the advantages of the underwater gliders realize the position adjustment of the center of gravity through an inclination adjustment mechanism and a deflection adjustment mechanism in an attitude adjustment module, but this mode determines that an adjustment range of the center of gravity is limited to some extent, in addition, a rotating mechanism and a deflection mechanism need to occupy a large internal space; Some of the heave survey platforms are adjusted by an upper fin rudder, but a main body of the heave survey platform is still in a vertical state and its horizontal motion performance is limited.

SUMMARY

In order to solve at least one technical problem mentioned above and other aspects in the prior art, the disclosure provides a heave survey platform. Two fixed wings are symmetrically disposed on two sides of a middle part of a body, and two variable wings are symmetrically disposed on two sides of a lower end of the body. By adjusting wing angles of the variable wings and included angles between the variable wings and the fixed wings, a lift force is generated on the heave survey platform, thus the heave survey platform can roll and/or translate in the process of sinking and floating to adjust the attitude of the heave survey platform.

In an aspect, an embodiment of the disclosure provides a heave survey platform, including: a body, two fixed wings and two variable wing mechanisms. The two fixed wings are symmetrically disposed on two sides of a middle part of the body, and an axis of the body is located in a plane defined by extension directions of the two fixed wings. Each variable wing mechanism includes a variable wing, and the two variable wings of the two variable wing mechanisms are symmetrically disposed on two sides of a lower end of the body, and each variable wing is configured to swing between a first position coplanar with the plane and a second position forming an angle with the plane to generate a lift force on the body at the second position, thereby to make the body move in a radial direction or change attitude.

In an embodiment of the disclosure, the body includes a lower diversion cover, a lower housing, an upper housing and an upper diversion cover which are sequentially connected from bottom to top in that order. A lower end cover is disposed between the lower diversion cover and the lower housing. An upper end cover is disposed between the upper diversion cover and the upper housing. The lower end cover, the lower housing, the upper end cover and the upper housing define a sealed cavity which is water-tight isolated from the lower diversion cover and the upper diversion cover, and a side wall of the lower diversion cover is provided with water drainage holes communicating with an external seawater environment.

In an embodiment of the disclosure, the fixed wings are disposed on the upper housing, and the variable wing mechanisms are disposed on the lower housing.

In an embodiment of the disclosure, each variable wing mechanism further includes: a driving part, a connecting shaft and a fixed shaft sleeve. The driving part is disposed in the lower housing, an end of the connecting shaft is connected with an output end of the driving part, and another end of the connecting shaft extends along the radial direction of the body and passes through the lower housing to install the variable wing. The fixed shaft sleeve is disposed on an outer wall surface of the lower housing and sleeved on an outside of the connecting shaft to isolate the external marine environment from the sealed cavity.

In an embodiment of the disclosure, each driving part includes: a first motor and a speed change assembly. The first motor is disposed in the lower housing. The speed change assembly includes: a worm gear connected with an output end of the first motor and a worm rod. An end of the worm rod is meshed with the worm gear, and another end of the worm rod is connected with the connecting shaft.

In an embodiment of the disclosure, the heave survey platform further includes a buoyancy mechanism, the buoyancy mechanism includes: an inner oil pocket assembly, an outer oil pocket assembly, an oil path control assembly and a detection assembly. The inner oil pocket assembly includes: an inner oil pocket disposed in the upper housing. The outer oil pocket assembly includes an outer oil pocket disposed in the lower diversion cover. The oil path control assembly is disposed in an oil path between the inner oil pocket and the outer oil pocket and configured to pump hydraulic oil between the inner oil pocket and the outer oil pocket. The detection assembly is disposed in the upper housing and configured to detect a volume change of the inner oil pocket to obtain a buoyancy borne by the body.

In an embodiment of the disclosure, the oil path control assembly includes: a miniature plunger pump, a direction control valve, a pressure reducing valve, a one-way valve and a second motor. An oil inlet end of the miniature plunger pump is connected with an oil outlet end of the inner oil pocket, and an oil outlet end of the miniature plunger pump is connected with an oil inlet end of the outer oil pocket, and the miniature plunger pump is configured to pump the hydraulic oil to the outer oil pocket from the inner oil pocket. A first inlet and a second inlet of the direction control valve are connected with an oil outlet end of the outer oil pocket, a third inlet of the direction control valve is cut off from the outer oil pocket, and an outlet of the direction control valve is connected with an oil inlet end of the inner oil pocket and is selectively connected to one of the first inlet, the second inlet and the third inlet to make the hydraulic oil to return to the inner oil pocket or be cut off in the outer oil pocket. The pressure reducing valve is disposed between one of the first inlet and the second inlet and the outer oil pocket and configured to reduce a pressure of the hydraulic oil flowing back to the inner oil pocket so as to reduce an oil return speed. The one-way valve is disposed between the miniature plunger pump and the outer oil pocket to form a unidirectional circulating oil path between the inner oil pocket and the outer oil pocket. An output end of the second motor is connected with a main shaft of the miniature plunger pump and configured to drive the miniature plunger pump.

In an embodiment of the disclosure, the heave survey platform further includes a control unit. The control unit includes: a controller and an attitude sensor. The controller is in communication connection with the miniature plunger pump, the direction control valve, the second motor and the first motors, and configured to control the miniature plunger pump, the direction control valve and the second motor to adjust the heave survey platform to be in a floating state or a diving state. The attitude sensor is in communication connection with the controller and configured to collect an attitude signal of the heave survey platform and transmit the attitude signal to the controller, and the controller is configured to control at least one first motor to adjust a wing angle of the corresponding variable wing according to the attitude signal.

In an embodiment of the disclosure, the inner oil pocket assembly further includes an inner oil pocket base disposed in the upper housing, and the inner oil pocket base is provided with an oil pocket interface configured to install the inner oil pocket.

In an embodiment of the disclosure, the detection assembly includes: guide shafts, an oil pocket upper cover, a connecting seat, a sensor support plate and a draw-wire displacement sensor. The guide shafts are disposed on the inner oil pocket base at intervals along a direction orthogonal to the inner oil pocket base. The oil pocket upper cover is disposed on an end of the inner oil pocket facing away from the oil pocket interface and slidably sleeved on the guide shafts. The connecting seat is disposed on the oil pocket upper cover. The sensor support plate is disposed at ends of the guide shafts facing away from the inner oil pocket base and disposed in parallel with the inner oil pocket base. The draw-wire displacement sensor is disposed at a position of the sensor support plate facing towards the connecting seat, and configured to detect a displacement change of the oil pocket upper cover to obtain a volume change signal of the inner oil pocket.

According to the heave survey platform provided by the disclosure, two fixed wings are symmetrically disposed on two sides of the middle part of the body, and two variable wings are symmetrically disposed on two sides of the lower end of the body, by adjusting wing angles of the variable wings and included angles between the variable wings and the fixed wings, the lift force can be generated on the heave survey platform, thus the heave survey platform can be translated; The heave survey platform is driven to generate a rotational torque to cause the heave survey platform to roll around the axis when the lifting forces generated by the two variable wings on the heave survey platform are different. The heave survey platform forms sawtooth wave motion in the vertical plane through controllable translation and/or rolling to offset the horizontal drift of the heave survey platform caused by ocean currents and other external interference in the marine environment.

DESCRIPTION OF REFERENCE SYMBOLS

1, variable wing mechanism; 101, first motor; 102, variable wing control circuit board; 103, speed change assembly; 104, thrust bearing; 105, O-ring; 106, fixed shaft sleeve; 107, ceramic bearing; 108, variable wing; 109, connecting shaft; 110, sealing shaft sleeve; 111, sealing coupling; 112, counter weight;

2, body; 201, lower diversion cover; 202, lower end cover; 203, lower connecting frame; 204, lower housing; 205, lower connecting rod; 206, housing connecting member; 207, upper connecting block; 208, connecting plate; 209, top connecting block; 210, upper connecting rod; 211, fastening nut; 212, upper diversion cover; 213, tail fin; 214, upper end cover; 215, fixed wing; 216, fixed wing mounting base; 217, upper housing; 218, water drainage hole;

3, buoyancy mechanism; 301, second motor; 302, coupling bracket; 303, miniature plunger pump; 304, hydraulic steel pipe; 305, inner oil pocket base; 306, guide shaft; 307, linear bearing; 308, guide shaft fixed base; 309, draw-wire displacement sensor; 310, sensor support plate; 311, connecting seat; 312, oil pocket upper cover; 313, inner oil pocket; 314, oil pocket interface; 315, one-way valve; 316, third tee joint; 317, pressure reducing valve; 318, first tee joint; 319, direction control valve; 320, coupling; 321, second tee joint; 322, direction control valve bracket; 323, direction control valve steering engine; 324, outer oil pocket base; 325, outer oil pocket;

4, control unit; 5, pressure sensor; 6, temperature sensor; 7, satellite positioning unit; 8, battery pack.

DETAILED DESCRIPTION OF EMBODIMENTS

In order to make the purpose, technical solution, and advantages of the disclosure clearer, the following is a detailed explanation of the disclosure in conjunction with specific embodiments and with reference to the accompanying drawings.

The terms used here are only intended to describe specific embodiments and are not intended to limit the disclosure. The terms "include", "contain", etc. used here indicate the existence of the features, steps, operations, and/or components, but do not exclude the existence or addition of one or more other features, steps, operations, or components.

All terms used here, including technical and scientific terms, have the meanings commonly understood by those skilled in the art, unless otherwise defined. It should be noted that the terms used here should be interpreted as having a meaning consistent with the context of the specification, and should not be interpreted in an idealized or overly rigid manner.

In the case of using expressions such as "at least one of A, B, and C", it should generally be explained according to the meaning commonly understood by those skilled in the art. For example, "a system with at least one of A, B, and C" should include but not be limited to a system with A, a system with B, a system with C, a system with A and B, a system with A and C, a system with B and C, and/or a system with A, B and C, etc.

Figure 1:
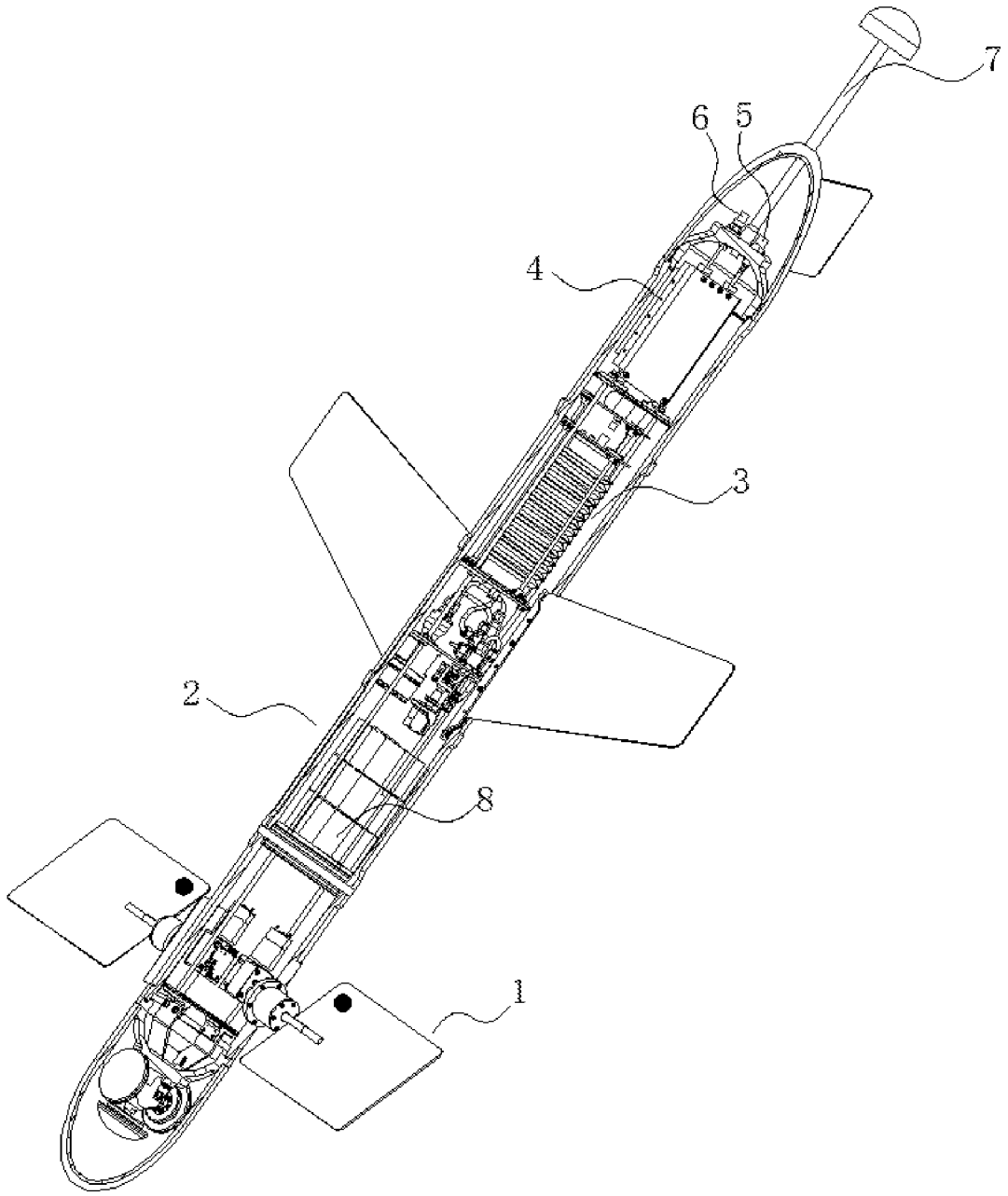
FIG. 1 illustrates a perspective view of a heave survey platform according to an exemplary embodiment of the disclosure.

FIG. 1 illustrates a perspective view of a heave survey platform according to an exemplary embodiment of the disclosure.

The disclosure provides a heave survey platform, as illustrated in FIG. 1, the heave survey platform includes a body 2, two fixed wings 215, and two variable wing mechanisms 1. The two fixed wings 215 are symmetrically disposed on two sides of a middle of the body 2, and an axis of the body 2 is located in a plane defined by extension directions of the two fixed wings 215. Each variable wing mechanism 1 includes a variable wing 108, and the two variable wings 108 of the two variable wing mechanisms 1 are symmetrically disposed on two sides of a lower end of the body 2. Each variable wing 108 is configured to swing between a first position that is coplanar with the plane and a second position that forms an angle with the plane (as illustrated in FIG. 1) to generate a lift force on the body 2 at the second position, thereby to make the body 2 to move radially or change its attitude.

In an illustrated embodiment, the fixed wing 215 is constructed into a roughly trapezoidal structure.

Specifically, a longer inclined edge of the trapezoidal structure of the fixed wing 215 is disposed towards the variable wing 108. It should be understood that embodiments of the disclosure are not limited to this.

For example, the fixed wing 215 is constructed in any shape including but not limited to triangle, rectangle, or another polygon.

In an illustrated embodiment, the variable wing 108 is constructed into a roughly rectangular structure.

Specifically, the variable wing 108 swings between the first and second positions on a centerline of a side of the rectangle as the axis. It should be understood that embodiments of the disclosure are not limited to this.

For example, the variable wing 108 is constructed in any shape including but not limited to triangle, trapezoid, or another polygon.

In an illustrated embodiment, the variable wing 108 and/or the fixed wing 215 include but are not limited to being made of carbon fiber or another non-metallic material.

In an illustrated embodiment, the heave survey platform further includes two tail wings 213.

Specifically, the two tail wings 213 are symmetrically disposed on two sides of a rear end of the body 2.

Furthermore, the two tail wings 213 are constructed perpendicular to the plane defined by the fixed wings 215.

In the embodiment, the two fixed wings 215 are symmetrically disposed on the two sides of the middle of the body 2, and the two variable wings 108 are symmetrically disposed on the two sides of the lower end of the body 2. By adjusting the wing angles of the variable wings 108 and the included angles between the variable wings 108 and the fixed wing 215, the lift force is generated on the lift survey platform, thus the heave survey platform can be translated; Under states of different lift forces generated by the two variable wings 108 on the lift survey platform, the lift survey platform is driven to generate a rotational torque to cause the lift survey platform to roll around the axis. The heave survey platform forms sawtooth wave motion in the vertical plane through controllable translation and/or roll to offset the horizontal drift of the heave survey platform caused by ocean currents and other external interference in the marine environment.

Figure 2:
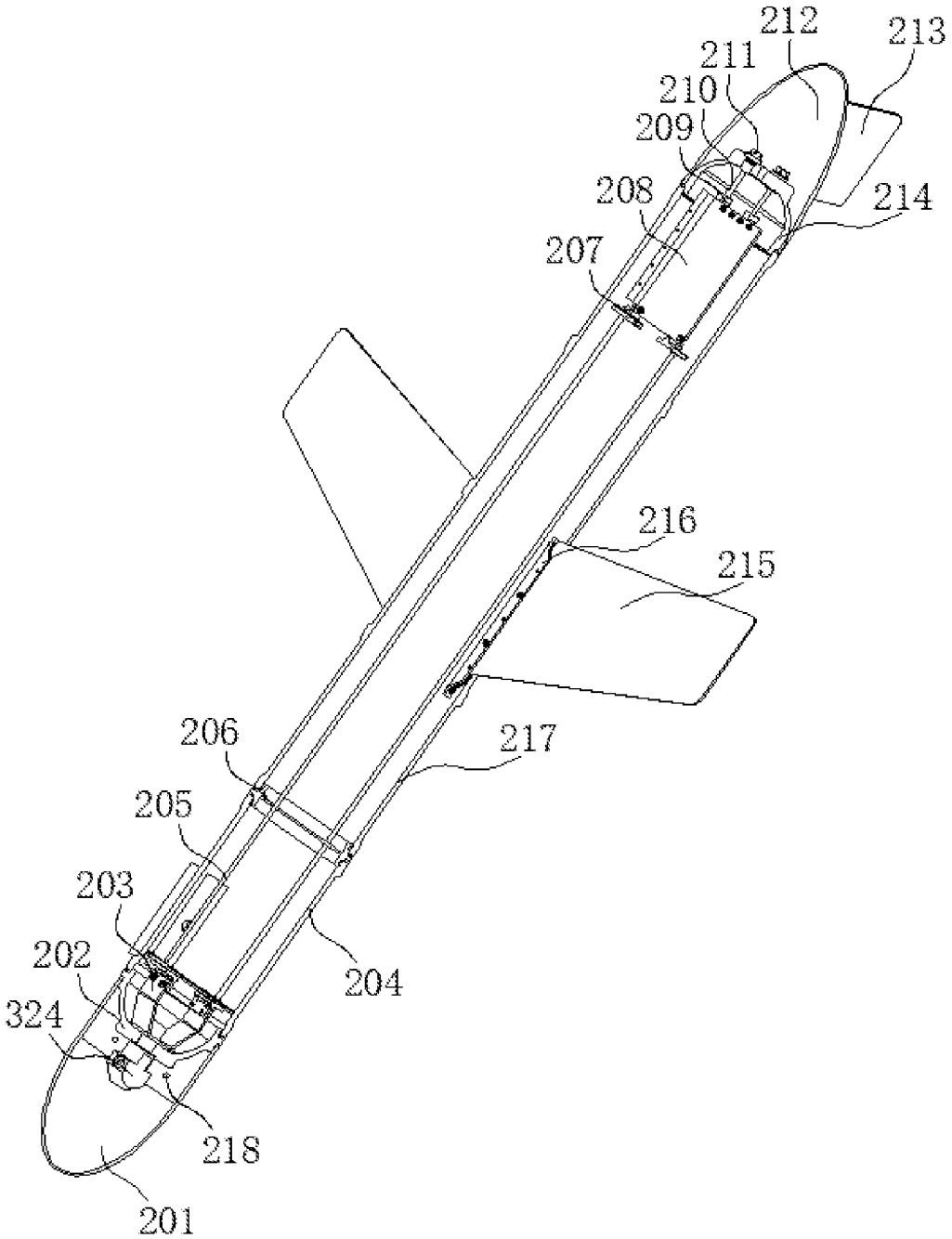
FIG. 2 illustrates a perspective view of a body of the heave survey platform illustrated in FIG. 1 according to an exemplary embodiment of the disclosure.

FIG. 2 illustrates a perspective view of the body 2 of the heave survey platform illustrated in FIG. 1 according to an exemplary embodiment of the disclosure.

According to the embodiment of the disclosure, as illustrated in FIG. 2, the body 2 includes a lower diversion cover 201, a lower housing 204, an upper housing 217 and an upper diversion cover 212 which are sequentially connected from bottom to top in that order, a lower end cover 202 is disposed between the lower diversion cover 201 and the lower housing 204, and an upper end cover 214 is disposed between the upper diversion cover 212 and the upper housing 217. The lower end cover 202, the lower housing 204, the upper end cover 214 and the upper housing 217 define a sealed cavity which is water-tight isolated from the lower diversion cover 201 and the upper diversion cover 212, and a side wall of the lower diversion cover 201 is provided with water drainage holes 218 communicating with an external seawater environment.

According to the embodiment of the disclosure, as illustrated in FIG. 2, the fixed wings 215 are disposed on the upper housing 217, and the variable wing mechanisms 1 are disposed on the lower housing 204.

In an illustrated embodiment, as illustrated in FIG. 2, each of the upper housing 217 and the lower housing 204 is constructed in a cylindrical structure.

Specifically, the upper housing 217 and the lower housing 204 are fixed by an annular housing connecting member 206.

In an embodiment, each of the upper diversion cover 212 and the lower diversion cover 201 is constructed in a roughly semi-ellipsoidal structure, thus the body 2 is roughly streamlined.

In an illustrated embodiment, as illustrated in FIG. 2, an upper end of the upper housing 217 is provided with an upper end cover 214.

Specifically, the upper end cover 214 is constructed in a disk-shaped structure adapted to an inner diameter of the upper housing 217 to close an upper part of the upper housing 217.

In an embodiment, the upper diversion cover 212 is disposed on an outside of the upper end cover 214.

In an illustrated embodiment, as illustrated in FIG. 2, a lower end of the lower housing 204 is covered with the lower end cover 202.

Specifically, the lower end cover 202 is constructed as a bowl-shaped mechanism adapted to the inner diameter of the lower housing 204 to close the lower part of the lower housing 204.

In an illustrated embodiment, the body 2 further includes multiple lower connecting frames 203.

Specifically, the lower connecting frame 203 is constructed as a ribbed structure. Ends of the lower connecting frames 203 are mounted on the lower end cover 202, and other ends of the lower connecting frames 203 are radially mounted on the lower part of the lower housing 204.

In an illustrated embodiment, the body 2 further includes lower connecting rods 205, a connecting plate 208 and upper connecting rods 210 which are disposed in the sealed cavity and connected in sequence from bottom to top in that order.

Specifically, the lower connecting rods 205 extend in a direction parallel to the axis of the body 2. An end of the lower connecting rod 205 in an axial direction is disposed on the lower end cover 202, and another end of the lower connecting rod is connected with an end of the connecting plate 208 through the upper connecting block 207. Another end of the connecting plate 208 is connected with an end of the upper connecting rod 210 through a top connecting block 209, and another end of the upper connecting rod 210 is disposed on the upper end cover 214, which is suitable for pulling the lower end cover 202 and the upper end cover 214 along the axial direction of the body 2 to limit the position of the lower end cover 202 relative to the upper end cover 214.

In an embodiment, the assembly of the lower connecting rods 205, the upper connecting block 207, the connecting plate 208, the top connecting block 209 and the upper connecting rods 210 includes but is not limited to the use of fastening nuts 211.

In an illustrated embodiment, as illustrated in FIG. 2, the body 2 further includes a fixed wing mounting seat 216 disposed on an outer wall of the upper housing 217.

Specifically, the fixed wing mounting seat 216 is internally provided with a groove structure extending in a direction substantially parallel to the axial direction of the body 2. In an embodiment, an outer edge of the fixed wing 215 facing towards the groove structure is embedded in the groove structure and fixed in the groove structure by the fastening nut 211.

In the embodiment, the lower end cover 202, the lower housing 204, the upper housing 217 and the upper end cover 214 form a sealed cavity sealed from the external marine environment, and the sealed cavity is configured to install parts of the variable wing mechanisms 1 and the buoyancy mechanism 3 that are isolated from the marine environment.

Figure 3:
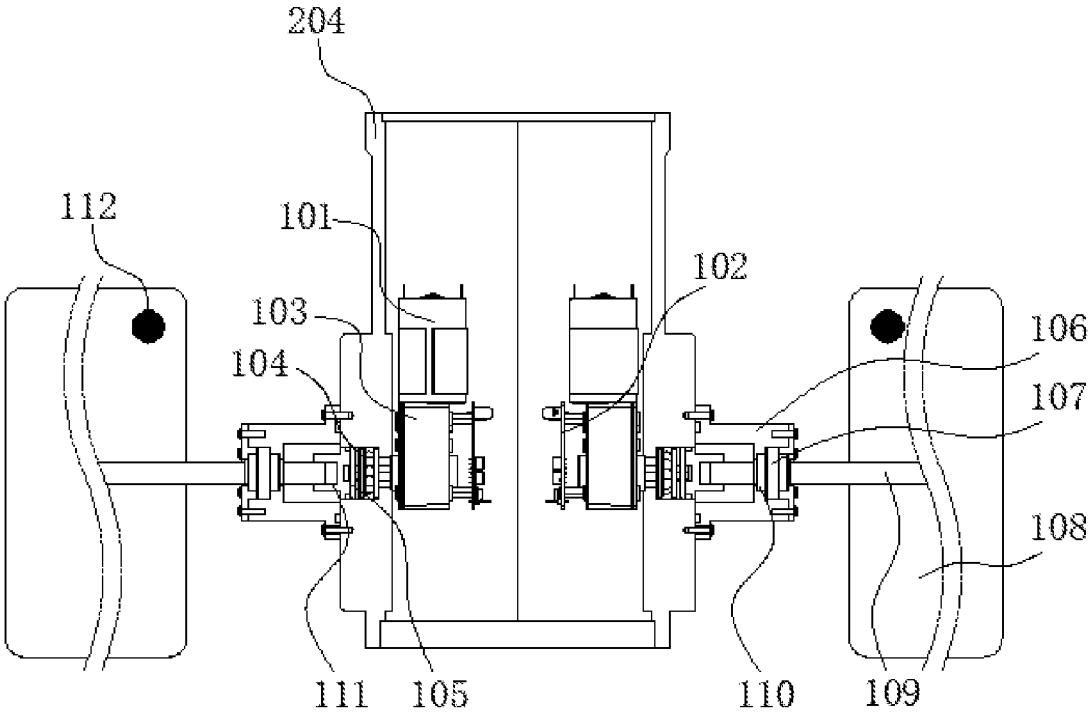
FIG. 3 illustrates a partial enlarged view of variable wing mechanisms of the heave survey platform illustrated in FIG. 1 according to an exemplary embodiment of the disclosure.

FIG. 3 illustrates a partial enlarged view of the variable wing mechanism 1 of the heave survey platform illustrated in FIG. 1 according to an exemplary embodiment of the disclosure.

According to the embodiment of the disclosure, as illustrated in FIG. 3, each variable wing mechanism 1 further includes a driving part, a connecting shaft 109 and a fixed shaft sleeve 106. The driving part is disposed in the lower housing 204. An end of the connecting shaft 109 is connected with an output end of the corresponding driving part, and another end of the connecting shaft 109 extends in the radial direction of the body 2 and passes through the lower housing 204 to mount the variable wing 108. The fixed shaft sleeve 106 is disposed on the outer wall surface of the lower housing 204 and sleeved an outside of the connecting shaft 109 to seal the external marine environment from the sealed cavity.

According to an embodiment of the disclosure, as illustrated in FIG. 3, the driving part includes a first motor 101 and a speed change assembly 103. The first motor 101 is disposed in the body 2. The speed change assembly 103 includes a worm gear and a worm rod. The worm gear is connected to the output end of the first motor 101. An end of the worm rod is engaged with the worm gear, and another end of the worm rod is connected with a first end of the connecting shaft 109.

In an illustrated embodiment, as illustrated in FIG. 3, the variable wing mechanism 1 further includes a variable wing control circuit board 102.

Specifically, the first motor 101, the speed change assembly 103 and the variable wing control circuit board 102 are rigidly linked.

In an embodiment, the worm rod of the speed change assembly 103 is concentrically and rigidly connected with an end of a sealing coupling 111, and the other end of the sealing coupling 111 is concentrically and rigidly connected with the connecting shaft 109.

Furthermore, an O-ring 105 is sleeved outside the sealing coupling 111 to form a dynamic sealing fit.

In an illustrated embodiment, the end of the connecting shaft 109 protruding from the lower housing 204 is rigidly connected with the variable wing 108.

Specifically, the axis of the connecting shaft 109 is approximately coincident with the center line of the variable wing 108.

In an illustrated embodiment, a thrust bearing 104 is disposed between the outer side of the sealing coupling 111 and the lower housing 204.

In an embodiment, a ceramic bearing 107 is disposed between the connecting shaft 109 and the fixed shaft sleeve 106.

Furthermore, sealing shaft sleeves 110 are concentrically disposed on two sides of the ceramic bearing 107 in an axial direction.

In an illustrated embodiment, a counter weight 112 (including but not limited to a lead block) is disposed on a wing surface of the variable wing 108 at a position eccentric to the connecting shaft 109, so as to overcome the influence of at least part of the fluctuation of the marine environment on the variable wing 108 when the variable wing 108 swings, reduce the jitter of the variable wing 108 caused by the fluctuation, and make the adjustment of the wing angle of the variable wing 108 more accurate and rapid.

In the embodiment, the driving part is suitable for driving the connecting shaft 109 to rotate so as to adjust the wing angle of the variable wing 108. The sealing shaft sleeve 110, the fixed shaft sleeve 106, the O-ring 105, the sealing coupling 111 and other seals are suitable for watertight isolation of the external marine environment from the sealed cavity in the lower housing 204. The thrust bearing 104 and the ceramic bearing 107 are suitable for maintaining the stability of the connecting shaft 109 in the rotating state, so as to reduce the influence of the fluctuation of the marine environment on the wing angle adjustment of the variable wing 108.

Figure 4:
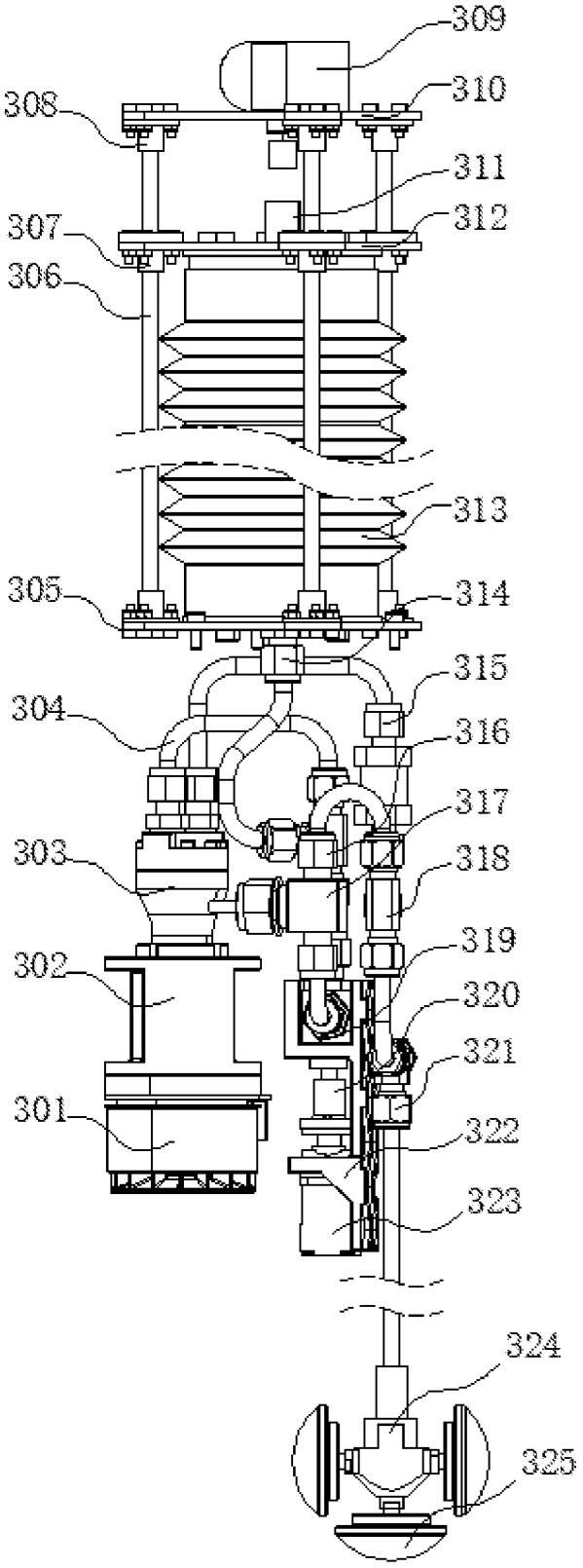
FIG. 4 illustrates a partial enlarged view of a buoyancy mechanism of the heave survey platform illustrated in FIG. 1 according to an exemplary embodiment of the disclosure.
Figure 5:
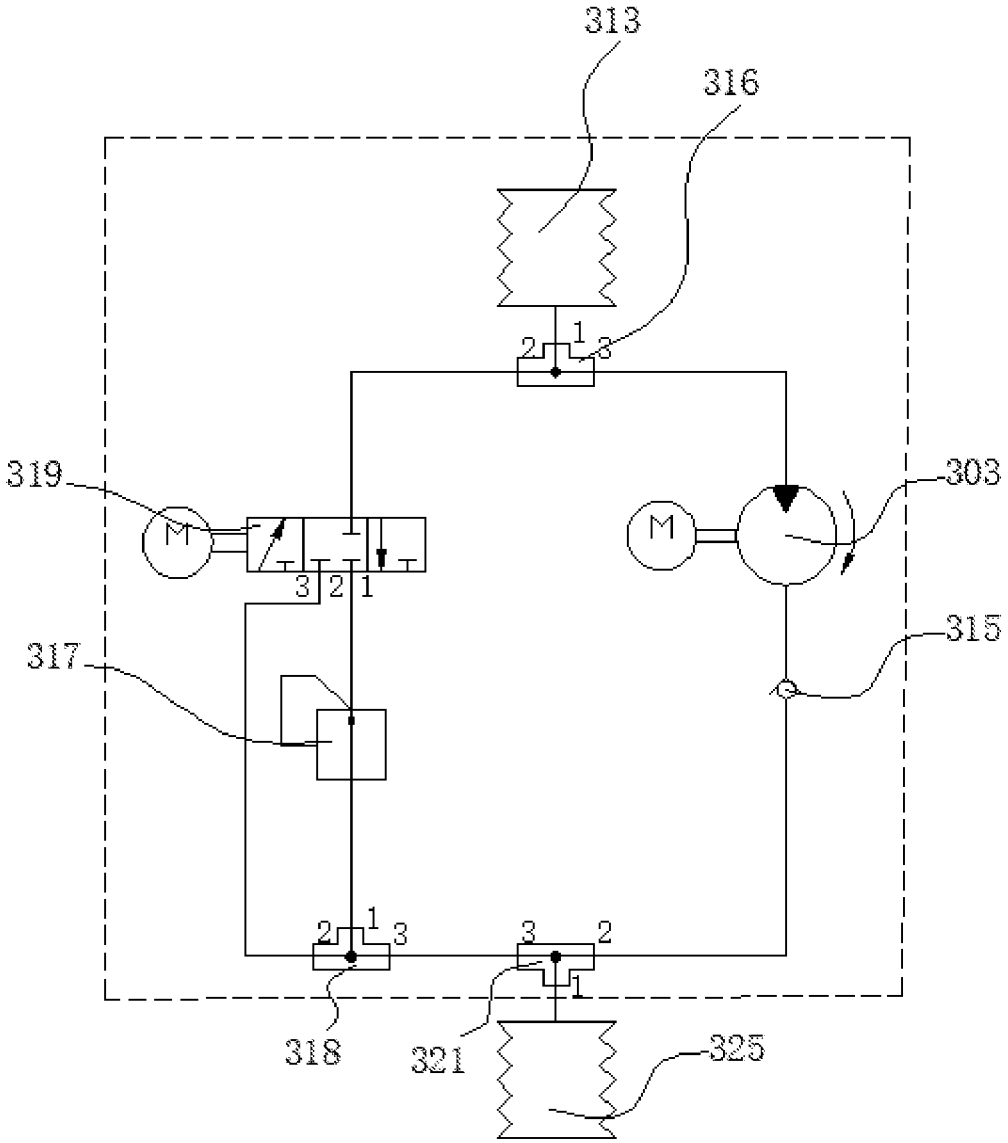
FIG. 5 illustrates an oil circuit diagram of the buoyancy mechanism illustrated in FIG. 4.

FIG. 4 illustrates a partial enlarged view of a buoyancy mechanism of the heave survey platform illustrated in FIG. 1 according to an exemplary embodiment of the disclosure. FIG. 5 illustrates an oil circuit diagram of the buoyancy mechanism illustrated in FIG. 4.

According to the embodiment of the disclosure, as illustrated in FIGS. 4 and 5, the heave survey platform further includes a buoyancy mechanism 3. The buoyancy mechanism 3 includes an inner oil pocket assembly, an outer oil pocket assembly, an oil path control assembly and a detection assembly. The inner oil pocket assembly includes an inner oil pocket 313 disposed in the upper housing 217. The outer oil pocket assembly includes an outer oil pocket 325 disposed in the lower diversion cover 201. The oil path control assembly is disposed in an oil path between the inner oil pocket 313 and the outer oil pocket 325, and is suitable for pumping hydraulic oil between the inner oil pocket 313 and the outer oil pocket 325. The detection assembly is disposed in the upper housing 217 and is suitable for detecting the volume change of the inner oil pocket 313 to obtain the buoyancy borne by the body 2.

According to the embodiment of the disclosure, as illustrated in FIGS. 4 and 5, the oil circuit control assembly includes a miniature plunger pump 303, a direction control valve 319, a pressure reducing valve 317, a one-way valve 315 and a second motor 301. The oil inlet of the miniature plunger pump 303 is connected with the oil outlet of the inner oil pocket 313, and the oil outlet end of the miniature plunger pump 303 is connected with the oil inlet end of the outer oil pocket 325, the miniature plunger pump 303 is suitable for pumping hydraulic oil from the inner oil pocket 313 to the outer oil pocket 325. The pressure reducing valve 317 is disposed between the first inlet or the second inlet and the outer oil pocket 325, and is suitable for reducing the pressure of hydraulic oil flowing back to the inner oil pocket 313, so as to reduce the oil return speed. The one-way valve 315 is disposed between the miniature plunger pump 303 and the outer oil pocket 325, thus a unidirectional circulating oil path is formed between the inner oil pocket 313 and the outer oil pocket 325. The output end of the second motor 301 is connected with the main shaft of the miniature plunger pump 303, and is suitable for driving the miniature plunger pump 303.

According to an embodiment of the disclosure, as illustrated in FIG. 1, the heave survey platform further includes a control unit 4. The control unit 4 includes a controller and an attitude sensor. The controller is in communication connection with the miniature plunger pump 303, the direction control valve 319, the second motor 301 and the first motors 101, and is suitable for controlling the miniature plunger pump 303, the direction control valve 319 and the second motor 301 to adjust the heave survey platform to be in an floating state or a diving state. The attitude sensor is in communication connection with the controller, and is suitable for collecting the attitude signal of the heave survey platform and transmitting it to the controller, and the controller controls at least one first motor 101 to adjust the wing angle of the variable wing 108 according to the attitude signal.

In an illustrated embodiment, as illustrated in FIG. 1, the control unit 4 is disposed in the upper housing 217.

In the embodiment, the controller is in communication connection with the second motor 301, the miniature plunger pump 303, the direction control valve 319 and the attitude sensor, so as to control the actions of the second motor 301, the miniature plunger pump 303 and the direction control valve 319 according to the control command, so as to adjust the working state of the heave survey platform, and acquire the attitude signal of the heave survey platform through the attitude sensor. The controller is in communication connection with the two variable wing mechanisms 1, and drives the variable wing 108 of at least one variable wing mechanism 1 to swing based on the attitude signal, so as to adaptively adjust the included angle of the corresponding variable wing 108 relative to the fixed wing 215, so as to adjust the attitude of the heave survey platform. In this way, the control of the variable wing mechanism 1 and the buoyancy mechanism 3 is integrated into the same control unit 4, which can control the attitude of the heave survey platform in real time in the process of floating or diving.

According to the embodiment of the disclosure, as illustrated in FIG. 4, the inner oil pocket assembly further includes an inner oil pocket base 305 disposed in the upper housing 217, and the inner oil pocket base 305 is provided with an oil pocket interface 314 suitable for installing the inner oil pocket 313.

According to the embodiment of the disclosure, as illustrated in FIG. 4, the detection assembly includes multiple guide shafts 306, an oil pocket upper cover 312, a connecting seat 311, a sensor support plate 310 and a draw-wire displacement sensor 309. The guide shafts 306 are disposed on the inner oil pocket base 305 at intervals along the direction orthogonal to the inner oil pocket base 305. The oil pocket upper cover 312 is disposed at the end of the inner oil pocket 313 facing away from the oil pocket interface 314, and is slidably sleeved on the guide shafts 306. The connecting seat 311 is disposed on the oil pocket upper cover 312. The sensor support plate 310 is disposed at ends of the guide shafts 306 facing away from the inner oil pocket base 305, and is arranged in parallel with the inner oil pocket base 305. The draw-wire displacement sensor 309 is disposed at the position of the sensor support plate 310 facing towards the connecting seat 311, and is suitable for detecting the displacement change of the oil pocket upper cover 312 to obtain the volume change signal of the inner oil pocket 313.

In an illustrated embodiment, as illustrated in FIGS. 2 and 4, an outer oil pocket base 324 is mounted on the lower end cover 202.

In an embodiment, the outer oil pocket base 324 is provided with multiple interfaces, and each interface is provided with the outer oil pocket 325 through threads.

In an illustrated embodiment, the inner oil pocket base 305 and the sensor support plate 310 are both constructed in a disk-shaped structure.

Specifically, multiple guide shaft fixed bases 308 are symmetrically arranged between the end face of the inner oil pocket base 305 and the opposite end face of the sensor support plate 310 to fix the two ends of each guide shaft 306.

In an embodiment, the inner oil pocket 313 is disposed between the inner oil pocket base 305 and the sensor support plate 310.

Furthermore, the inner oil pocket base 305 is provided with an installation hole, and the oil pocket interface 314 of the inner oil pocket 313 is disposed in the installation hole and extends through the installation hole from the end face of the inner oil pocket base 305 facing away from the sensor support plate 310.

In an illustrated embodiment, as illustrated in FIG. 4, multiple linear bearing 307 (corresponding to the number of the guide shafts 306) are disposed at the outer edge of the oil pocket upper cover 312 at even intervals.

Specifically, each linear bearing 307 is slidably sleeved outside the guide shaft 306.

Furthermore, the guide shaft 306 includes, but is not limited to, a straight-line optical axis.

In an illustrated embodiment, the inner oil pocket 313 includes, but is not limited to, an organ structure.

Specifically, the center line of the inner oil pocket 313 is approximately coincident with the centers of the inner oil pocket base 305, the oil pocket upper cover 312 and the sensor support plate 310.

In the embodiment, when the hydraulic oil enters or is pumped out of the inner oil pocket 313, the direction of expansion or contraction of the inner oil pocket 313 is limited by the oil pocket upper cover 312 and the guide shafts 306, so it can deform along the centerline direction of the inner oil pocket 313 to get close to or away from the draw-wire displacement sensor 309. Since the diameter of the oil pocket is known, the volume variable of the inner oil pocket 313 (that is, the volume variable of the outer oil pocket 325) can be obtained by the displacement variable detected by the draw-wire displacement sensor 309, so as to obtain the buoyancy (i.e., buoyancy change) borne by the body 2.

In an illustrated embodiment, the oil path between the inner oil pocket 313 and the outer oil pocket 325 includes a pipeline and three three-way valves.

Specifically, the pipeline includes, but is not limited to, hydraulic steel pipe 304.

Furthermore, the first port of the first tee joint 318 is connected with the first inlet of the direction control valve 319, the second port of the first tee joint 318 is connected with the second inlet of the direction control valve 319, the third port of the first tee joint 318 is connected with the third port of the second tee joint 321, the first port of the second tee joint 325 is connected with the outer oil pocket 325, the second port of the second tee joint 321 is connected with the third port of the third tee joint 316, the first port of the third tee joint 316 is connected with the inner oil pocket 313, and the second port of the third tee joint 316 is connected with the direction control valve 319.

Furthermore, a pressure reducing valve 317 is disposed between the first port of the first tee joint 318 and the first inlet of the direction control valve 319, and a miniature plunger pump 303 and a one-way valve 315 are sequentially disposed between the third port of the third tee joint 316 and the second port of the second tee joint 321.

In an illustrated embodiment, the oil circuit control assembly further includes a coupling bracket 302.

Specifically, a second motor 301 (including but not limited to a DC brushless motor) is disposed on the coupling bracket 302.

Furthermore, the output end of the second motor 301 is connected with the main shaft of the miniature plunger pump 303 through the piston pump coupling 320 in the coupling bracket 302 to drive the miniature plunger pump 303.

In an illustrated embodiment, the oil circuit control assembly further includes a direction control valve bracket 322.

Specifically, the direction control valve steering gear 323 is disposed on the direction control valve bracket 322 and connected with the direction control valve 319 through the coupling 320 of the direction control valve 319, so as to drive the outlet of the direction control valve 319 to switch among the first position (conducting with the first inlet), the second position (conducting with the second inlet) and the third position (conducting with the third inlet).

In this embodiment, controlling the direction control valve 319 through the direction control valve steering gear 323, the direction control valve 319 can be switched among the first position to the third position, thus the oil path between the inner oil pocket 313 and the outer oil pocket 325 can be in three states: low-pressure conduction, high-pressure conduction and cut-off. In this way, in the low-voltage conduction state, the hydraulic oil flows back from the outer oil pocket 325 to the inner oil pocket 313 through the pressure reducing valve 317, and the drainage volume of the outer oil pocket 325 slowly decreases, and the buoyancy is less than its own weight, which makes the heave survey platform dive at a low speed. In the high-voltage conduction state, the hydraulic oil flows back from the outer oil pocket 325 to the inner oil pocket 313 according to the power of the miniature plunger pump 303, and the drainage volume of the outer oil pocket 325 decreases rapidly, and the buoyancy is less than its own weight, which makes the heave survey platform dive at high speed. In the cut-off state, the oil path of the outer oil pocket 325 to the inner oil pocket 313 is closed, and the hydraulic oil flows from the inner oil pocket 313 to the outer oil pocket 325 under the action of the miniature plunger pump 303, and the outer oil pocket 325 expands to discharge the water from the water drainage hole 218, thus the drainage volume is increased, and the buoyancy is greater than the self-weight of the heave survey platform, and the heave survey platform floats. In this way, in the process of diving and floating of the heave survey platform, the wing angle of the variable wing 108 can be controlled according to the working state and speed of the heave survey platform, thus the heave survey platform can move horizontally and/or roll.

In an illustrated embodiment, as illustrated in FIG. 1, the heave survey platform further includes a detection mechanism. The detection mechanism includes a temperature sensor 6 and a pressure sensor 5. The temperature sensor 6 is disposed in the upper diversion cover 212 and is suitable for collecting the temperature signal of the marine environment where the heave survey platform is located. The pressure sensor 5 is suitable for collecting the pressure signal of the marine environment where the heave survey platform is located.

In an illustrated embodiment, as illustrated in FIG. 1, both the temperature sensor 6 and the pressure sensor 5 are disposed in the upper diversion cover 212.

In an illustrated embodiment, as illustrated in FIG. 1, the heave survey platform further includes a satellite positioning unit 7. The satellite positioning unit 7 is disposed on the upper diversion cover 212 and is suitable for collecting the position signal of the heave survey platform.

In an illustrated embodiment, an upper end of the upper diversion cover 212 is provided with a through hole.

Furthermore, the satellite positioning unit 7 is disposed in the upper diversion cover 212, and a communication module of the satellite positioning unit 7 is concentrically arranged with the main body of the satellite communication unit, and passes through the upper diversion cover 212 through the through hole.

In an illustrated embodiment, as illustrated in FIG. 1, the heave survey platform further includes a battery pack 8.

Specifically, the battery pack 8 is disposed in the upper housing 217, and is electrically connected with the variable wing mechanism 1 and/or the buoyancy mechanism 3, and is suitable for supplying power to at least one of electrical components of the heave survey platform.

It should be noted that directional terms mentioned in the embodiments, such as "up", "down", "front", "back", "left" and "right", only refer to the directions of the drawings and are not used to limit the scope of protection of the disclosure. Throughout the drawings, same elements are indicated by same or similar reference numerals. Conventional structures or constructions will be omitted when it may lead to confusion in the understanding of the disclosure.

The embodiments of the disclosure have been described above. However, these embodiments are only for illustrative purposes, and are not intended to limit the scope of the disclosure. Although each embodiment has been described separately above, this does not mean that measures in each embodiment cannot be used in combination. The scope of the disclosure is defined by the appended claims and their equivalents. Without departing from the scope of the disclosure, those skilled in the art can make various substitutions and modifications, which should fall within the scope of the disclosure.

What is claimed is:

1. A heave survey platform, comprising:

a body, comprising a lower diversion cover, a lower housing, an upper housing and an upper diversion cover which are sequentially connected from bottom to top in that order;

two fixed wings, symmetrically disposed on two sides of a middle part of the body; wherein an axis of the body is located in a plane defined by extension directions of the two fixed wings;

two variable wing mechanisms, wherein each of the two variable wing mechanisms comprises a variable wing, the two variable wings of the two variable wing mechanisms are symmetrically disposed on two sides of a lower end of the body, and each variable wing is configured to swing between a first position coplanar with the plane and a second position forming an angle with the plane to generate a lift force on the body at the second position, thereby to make the body move in a radial direction or change attitude;

a buoyancy mechanism comprising:

an inner oil pocket assembly, comprising: an inner oil pocket disposed in the upper housing;

an outer oil pocket assembly, comprising: an outer oil pocket disposed in the lower diversion cover;

an oil path control assembly, disposed in an oil path between the inner oil pocket and the outer oil pocket, and configured to pump hydraulic oil between the inner oil pocket and the outer oil pocket, wherein the oil path control assembly comprises:

a miniature plunger pump, wherein an oil inlet end of the miniature plunger pump is connected with an oil outlet end of the inner oil pocket, and an oil outlet end of the miniature plunger pump is connected with an oil inlet end of the outer oil pocket, and the miniature plunger pump is configured to pump the hydraulic oil to the outer oil pocket from the inner oil pocket;

a direction control valve, wherein a first inlet and a second inlet of the direction control valve are connected with an oil outlet end of the outer oil pocket, a third inlet of the direction control valve is cut off from the outer oil pocket, and an outlet of the direction control valve is connected with an oil inlet end of the inner oil pocket and is selectively connected to one of the first inlet, the second inlet and the third inlet to make the hydraulic oil to return to the inner oil pocket or be cut off inside the outer oil pocket, so as to change a drainage volume of the outer oil pocket;

a pressure reducing valve, disposed between one of the first inlet and the second inlet and the outer oil pocket and configured to reduce a pressure of the hydraulic oil flowing back to the inner oil pocket, thereby to reduce an oil return speed and change a change speed of the drainage volume of the outer oil pocket;

a one-way valve, disposed between the miniature plunger pump and the outer oil pocket to form a unidirectional circulating oil path between the inner oil pocket and the outer oil pocket; and a second motor, wherein an output end of the second motor is connected with a main shaft of the miniature plunger pump and configured to drive the miniature plunger pump;

wherein the heave survey platform has a first-pressure conduction state, a second-pressure conduction state and a cut-off state; in the first-pressure conduction state, the hydraulic oil flows back from the outer oil pocket to the inner oil pocket through the pressure reducing valve, thereby to make the heave survey platform dive; in the second-pressure conduction state, the hydraulic oil flows back from the outer oil pocket to the inner oil pocket according to a power of the miniature plunger pump, thereby to make the heave survey platform dive at a speed higher than that of the first-pressure conduction state; and in the cut-off state, the hydraulic oil flows back from the inner oil pocket to the outer oil pocket through the miniature plunger pump, thereby to make the heave survey platform float.

2. The heave survey platform according to claim 1, wherein the body further comprises:

a lower end cover, disposed between the lower diversion cover and the lower housing; and an upper end cover, disposed between the upper diversion cover and the upper housing;

wherein the lower end cover, the lower housing, the upper end cover and the upper housing define a sealed cavity which is water-tight isolated from the lower diversion cover and the upper diversion cover, and a side wall of the lower diversion cover is provided with water drainage holes communicating with an external seawater environment.

3. The heave survey platform according to claim 2, wherein the fixed wings are disposed on the upper housing, and the variable wing mechanisms are disposed on the lower housing.

4. The heave survey platform according to claim 3, wherein each variable wing mechanism further comprises:

a driving part, disposed in the lower housing;

a connecting shaft, wherein an end of the connecting shaft is connected with an output end of the driving part, and another end of the connecting shaft extends along the radial direction of the body and passes through the lower housing to install the variable wing; and a fixed shaft sleeve, disposed on an outer wall surface of the lower housing and sleeved on an outside of the connecting shaft to isolate the external marine environment from the sealed cavity.

5. The heave survey platform according to claim 4, wherein the driving part comprises:

a first motor, disposed in the lower housing;

a speed change assembly comprising:

a worm gear, connected with an output end of the first motor; and a worm rod, an end of the worm rod being meshed with the worm gear, and another end of the worm rod being connected with the connecting shaft.

6. The heave survey platform according to claim 1, wherein the buoyancy mechanism further comprises: a detection assembly disposed in the upper housing and configured to detect a volume change of the inner oil pocket to obtain a buoyancy borne by the body.

7. The heave survey platform according to claim 1, further comprising a control unit, and the control unit comprising:

a controller, in communication connection with the miniature plunger pump, the direction control valve, the second motor and the first motors; wherein the controller is configured to control the miniature plunger pump, the direction control valve and the second motor to adjust the heave survey platform to be in a floating state or a diving state; and an attitude sensor, in communication connection with the controller; wherein the attitude sensor is configured to collect an attitude signal of the heave survey platform and transmit the attitude signal to the controller, and the controller is configured to control at least one of the first motors to adjust a wing angle of the corresponding variable wing according to the attitude signal.

8. The heave survey platform according to claim 6, wherein the inner oil pocket assembly further comprises an inner oil pocket base disposed in the upper housing, and the inner oil pocket base is provided with an oil pocket interface configured to install the inner oil pocket.

9. The heave survey platform according to claim 8, wherein the detection assembly comprises:

a plurality of guide shafts, disposed on the inner oil pocket base at intervals along a direction orthogonal to the inner oil pocket base;

an oil pocket upper cover, disposed on an end of the inner oil pocket facing away from the oil pocket interface and slidably sleeved on the plurality of guide shafts;

a connecting seat, disposed on the oil pocket upper cover;

a sensor support plate, disposed at ends of the plurality of guide shafts facing away from the inner oil pocket base and disposed in parallel with the inner oil pocket base;

a draw-wire displacement sensor, disposed at a position of the sensor support plate facing towards the connecting seat, and configured to detect a displacement change of the oil pocket upper cover to obtain a volume change signal of the inner oil pocket.

* * * * *